US007442101B2

(12) United States Patent
Kawase et al.

(10) Patent No.: US 7,442,101 B2
(45) Date of Patent: Oct. 28, 2008

(54) POWER SUPPLY SYSTEM FOR BOAT LAN SYSTEM COPING WITH PLURAL ENGINES

(75) Inventors: Koji Kawase, Shizuoka-ken (JP); Nobuto Tsuda, Shizuoka-ken (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 11/257,254

(22) Filed: Oct. 24, 2005

(65) Prior Publication Data

US 2006/0089060 A1 Apr. 27, 2006

(30) Foreign Application Priority Data

Oct. 22, 2004 (JP) ..... 2004-308644

(51) Int. Cl.
*B63H 21/22* (2006.01)
*B60W 10/04* (2006.01)

(52) U.S. Cl. ..... 440/1; 440/84; 440/87

(58) Field of Classification Search ..... 440/1–3, 440/84, 87

See application file for complete search history.

(56) References Cited

U.S. PATENT DOCUMENTS 5,685,802 A * 11/1997 Kanno ..... 477/111
6,382,122 B1 5/2002 Gaynor et al.
6,872,106 B2 * 3/2005 Kanno ..... 440/2
6,987,376 B2 * 1/2006 Kanno ..... 320/132
7,144,283 B2 * 12/2006 Kawase ..... 440/84
7,189,125 B2 * 3/2007 Okuyama ..... 440/1
2003/0093196 A1 * 5/2003 Okuyama ..... 701/21
2005/0170708 A1 * 8/2005 Okuyama ..... 440/1
2005/0287880 A1 * 12/2005 Okuyama ..... 440/1

* cited by examiner

*Primary Examiner*—Lars A Olson
*Assistant Examiner*—Daniel V. Venne
(74) *Attorney, Agent, or Firm*—Knobbe, Martens, Olson & Bear, LLP

(57) ABSTRACT

A power supply system for a boat LAN system with plural engines can comprise operator's devices, such as speedometers, tachometers, remote controls, and the like in the hull. Plural propulsion units can be mounted on the hull, each of which can include engines for driving respectively the plural propulsion units. A boat LAN system can constitute a communication network between the operator's devices and engine control sections of the engines. Batteries can be provided corresponding to the engines and connected through power switches. A system power supply circuit can also be provided for connecting a battery of selected one of the plural propulsion units to the boat LAN system. Switching circuits for connection to the boat LAN system while bypassing the power switch corresponding to the selected one propulsion unit can be provided which correspond to other power switches of other propulsion units. Drive circuits for turning on and off the switching circuits as interlocked with other power switches can also be provided. Plural switching circuits corresponding to the power switches of the respective propulsion unit engines are connected in parallel with the battery of the selected one propulsion unit. Drive circuits for turning on and off the corresponding switching circuits as interlocked with the respective power switches are provided.

4 Claims, 3 Drawing Sheets

POWER SUPPLY SYSTEM FOR BOAT LAN SYSTEM COPING WITH PLURAL ENGINES

PRIORITY INFORMATION

This application is based on and claims priority under 35 U.S.C. § 119 to Japanese Patent Application No. 2004-308644, filed on Oct. 22, 2004, the entire contents of which is hereby expressly incorporated by reference herein.

BACKGROUND OF THE INVENTION

1. Field of the Invention

The present inventions are directed to control systems for controlling various devices on a boat, such as boats with one or more outboard motors.

2. Description of the Related Art

Outboard motor-powered boats usually have many kinds of wires, cables and hoses for connecting the inboard equipment with the outboard motor. The number and types of connections of the wires, cables and hoses required for installing an outboard motor onto a boat makes the installation process slow, particularly if a plurality of outboard motors are mounted to the boat.

In recent years, local area networks (LAN) have become more popular for use in connecting components of a boat. In these types of systems, one or plurality of outboard motors are connected to devices, such as remote control devices, speedometers, tachometers, etc. Various kinds of signals are transmitted between the outboard motors and the inboard devices.

For example, U.S. Pat. No. 6,382,122 describes a system in which devices disposed, for example, in a pilot's seating area are connected through a LAN system forming a network between the devices and engine controllers of a plurality of outboard motors mounted on the stern.

SUMMARY OF THE INVENTION

An aspect of at least one of the embodiments disclosed herein includes the realization that difficulties can arise in initiating the power supply to a network on a vehicle, particularly where the vehicle includes multiple propulsion units. For example, where the engines of a vehicle having multiple engines are started and run independently from each other, the initiation of a networked used for controlling the engines should be activated regardless of which engine is activated. Thus, the power controller for the networking hardware can be complicated if it is to be designed to power the networking hardware from a plurality of different power supplies.

Thus, in accordance with at least one embodiment, a power supply system is provided for a networking system of a boat having a plurality of engines. The boat has a plurality of devices disposed in an operator's area of the hull of a boat, a plurality of propulsion units, including at least a first propulsion unit, supported by the hull, a plurality of engines having engine controllers and being configured to power the respective propulsion units, and a networking system comprising a communication network between the devices and the controllers. The boat also includes a plurality of batteries, including at least a first battery, corresponding to the plurality of engines and connected to the respective engines through a plurality of respective power switches, including at least a first power switch, the first power switch connecting the first battery to the first propulsion unit. The power supply system can comprise a system power supply circuit configured to connect the first battery to the networking system, a plurality of switching circuits configured to connect the first battery to the networking system while bypassing the first power switch, and drive circuits configured to turning on and turn off the switching circuits as interlocked with power switches other than the first power switch.

In accordance with at least another embodiment, a power supply system is provided for a networking system of a boat having a plurality of engines. The boat can include a plurality of devices can be disposed in an operator's area of the hull of a boat, a plurality of propulsion units, including at least a first propulsion unit, supported by the hull, and a plurality of engines having engine controllers and being configured to power the respective propulsion units. The boat can also include a networking system comprising a communication network between the devices and the controllers, a plurality of batteries corresponding to the plurality of engines and connected to the respective engines through a plurality of respective power switches. A system power supply circuit can be configured to connect a first battery of the plurality of batteries to the boat LAN system, and a plurality of switching circuits corresponding to the power switches of the respective propulsion unit engines can be connected in parallel with the first battery, as well as drive circuits configured to turn on and turn off the corresponding switching circuits as interlocked with the respective power switches.

In accordance with at least yet another embodiment, a power supply system can be provided for a boat that includes a hull, at least first and second propulsion units supported by the hull, and at least first and second batteries. The boat can also include at least first and second power switches configured to allow a user to activate the first and second propulsion units, respectively, by connecting the respective battery to the respective propulsion unit. The boat can further include a plurality of operator's devices disposed within the hull and a communication network connecting the plurality of devices with the plurality of propulsion units. The power supply system can comprise a power supply circuit configured to supply power from the first battery to the communication network when either one of the first and second power switches is activated.

In accordance with at least a further embodiment, a boat can comprise a hull, at least first and second propulsion units supported by the hull, and at least first and second batteries. At least first and second power switches can be configured to allow a user to activate the first and second propulsion units, respectively, by connecting the respective battery to the respective propulsion unit. A plurality of operator's devices can be disposed within the hull and a communication network can be used to connect the plurality of devices with the plurality of propulsion units. A power supply circuit configured to supply power from the first battery to the communication network when either one of the first and second power switches is activated.

DETAILED DESCRIPTION OF THE PREFERRED EMBODIMENT

Figure 1:
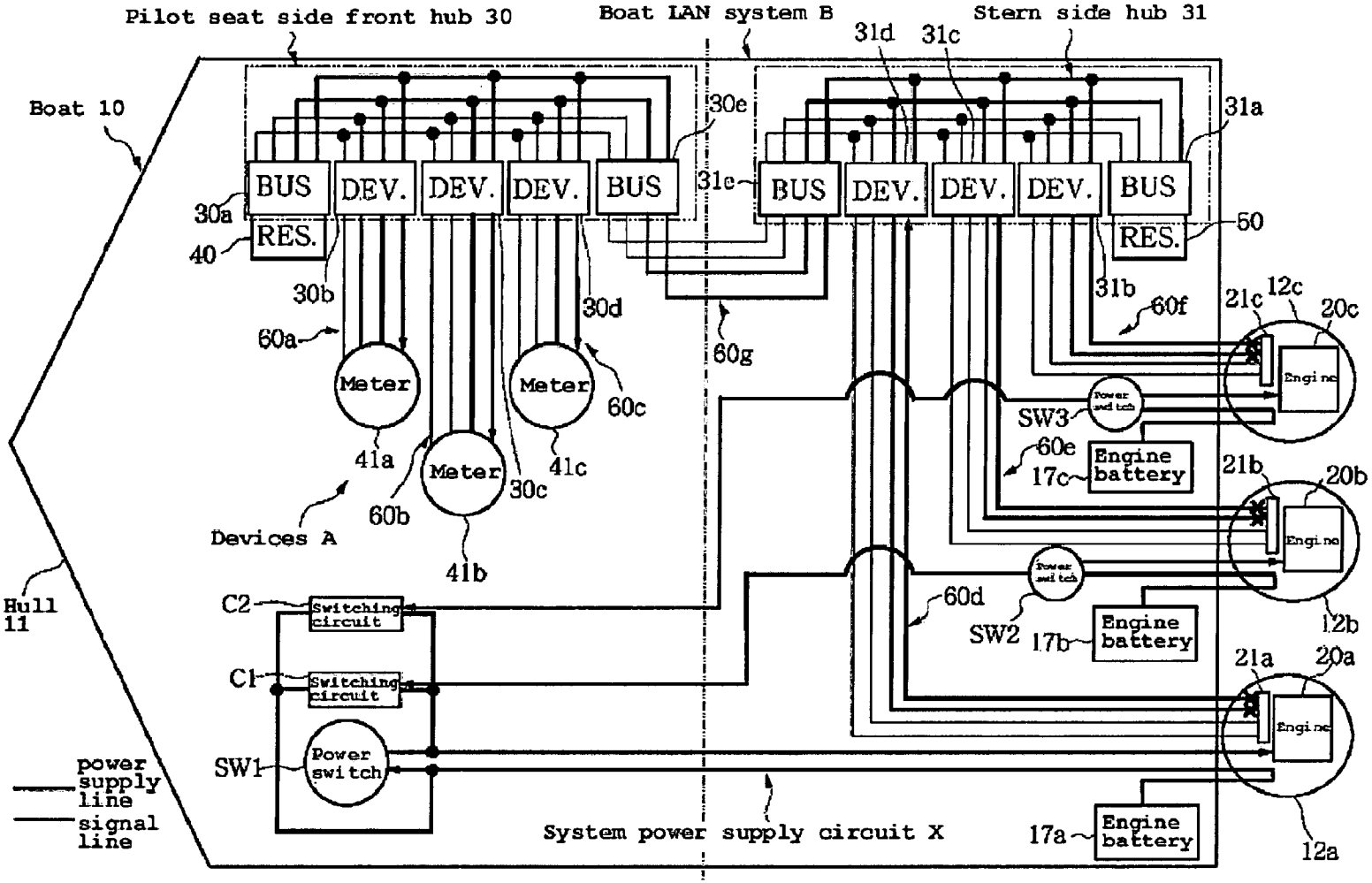
FIG. 1 is a schematic illustration of a boat having a LAN system connecting propulsion units with operator's devices disposed in the operator's seating area.

FIG. 1 is a schematic top plan view of a boat 10 including a LAN connecting a plurality of outboard motors. The embodiments disclosed herein are described in the context of a marine propulsion system of a boat because these embodiments have particular utility in this context. However, the embodiments and inventions herein can also be applied to other marine vessels, such as personal watercraft and small jet boats, as well as other land and marine vehicles. It is to be understood that the embodiments disclosed herein are exemplary but non-limiting embodiments, and thus, the inventions disclosed herein are not limited to the disclosed exemplary embodiments.

The boat 10 of this embodiment has a hull 11 for passengers on board and three outboard motors 12*a*, 12*b*, 12*c* mounted as propulsion units for the hull 11, at the stern of the boat 10. The outboard motors 12*a*, 12*b*, 12*c* have engines 20*a*, 20*b*, 20*c* and engine controls 21*a*, 21*b*, 21*c*, respectively. Although in this embodiment three outboard motors 12*a*, 12*b*, 12*c* are mounted to the hull 11 at the stern, one, two, or more than three outboard motors can be mounted to the hull.

A pilot seat-side front hub 30 is disposed at the front of the hull 11 and a stern-side hub 31 is disposed at the rear of the hull 11. These hubs 30, 31 are used as current or signal collectors/distributors in the manner well-known in the art of networking.

The pilot seat-side front hub 30 can be provided with, as shown in FIG. 1, a terminating resistance connecting terminal BUS30*a*, device connecting terminals DEV30*b*-30*d*, and a HUB connecting terminal BUS30*e*. The terminating resistance connecting terminal BUS30*a* is connected with a terminating resistance device RES40.

The device connecting terminals DEV30*b*-30*d* can be connected with meters 41*a*, 41*b*, 41*c* constituting devices A, by Controller Area Network (CAN)-supporting LAN cables 60*a*, 60*b*, 60*c*. The meters 41*a*, 41*b*, 41*c* can be in the form of speedometers, oil pressure and/or level gauges, tachometers, and/or remote control devices for adjusting throttle position or gear position, and the like. Such devices are also referred to herein as "operator's devices."

The stern-side hub 31 can be provided with, as shown in FIG. 1 and FIG. 4, a terminating resistance connecting terminal BUS31*a*, engine connecting terminals DEV31*b*-31*d*, and a HUB connecting terminal BUS31*e*. The terminating resistance connecting terminal BUS31*a* can be connected with a terminating resistance device RES50.

The engine connecting terminals DEV31*b*-31*d* can be connected with the engine controllers 21*a*, 21*b*, 21*c* with the LAN cables 60*d*, 60*e*, 60*f*. The LAN cables 60*d*, 60*e*, 60*f* can each have signal lines and power supply lines. The engine controllers 21*a*, 21*b*, 21*c* can be connected through the signal lines of the LAN cables 60*d*, 60*e*, 60*f* (although such connections are not illustrated in FIG. 2 or 3).

Further, although the power supply lines are included in the LAN cables 60*d*, 60*e*, 60*f* connecting the stern-side hub 31 to the engine controllers 21*a*, 21*b*, 21*c*, no electric power is transmitted between the stern side hub 31 and the engine controllers through these lines. Rather, as indicated by the "x" marks, no electric power is transmitted through the LAN cables 60*d*, 60*e*, 60*f*. Therefore, the boat LAN system is configured such that no power is supplied through the controllers of the engines 21*a*, 21*b*, 21*c* to the LAN.

The hub connection terminal BUS 30*e* of the pilot seat side front hub 30 and the hub connection terminal BUS 31*e* of the stern side hub 31 are interconnected through a bus cable 60*g*. The bus cable 60*g* has signal lines and power supply lines. Some embodiments can comprise a boat LAN system B providing a communication network between the devices A and the engine control sections 21*a*, 21*b*, and 21*c*.

The illustrated embodiment includes three outboard motors 12*a*, 12*b*, and 12*c*, their respective engines 20*a*, 20*b*, and 20*c*, and their respective batteries 17*a*, 17*b*, and 17*c* which are interconnected through power switches SW1, SW2, and SW3.

The battery 17*a* of the engine 20*a* of the outboard motor 12*a* can be connected to the boat LAN system B to constitute a system power supply circuit X, although any of the outboard motors 12*a*, 12*b*, 12*c*, can be used. The system power supply circuit X can be provided with switching circuits C1 and C2, bypassing the power switch SW1, corresponding to the power switches SW2 and SW3 of the engines 20*b* and 20*c* of other outboard motors 12*b* and 12*c*. Drive circuits D1 and D2 for turning on and off the switching circuits C1 and C2 as interlocked with the power switches SW2 and SW3 can also be provided. The switching circuits C1 and C2 can be, for example, relay circuits. Where relay circuits are used, of a normally open contact point type, it may be either of a mechanical contact point type or a non-contact type of semiconductor relay circuit.

When the power switch SW1 of the illustrated embodiment is turned on, it is possible to connect the battery 17*a* to both the engine 20*a* of the outboard motor 12*a* and the boat LAN system B. Further, when the power switch SW2 is turned on, it is possible to connect the battery 17*b* to the engine 20*b* of the outboard motor 12*b*. At the same time, it is possible to turn on the switching circuit C1 with the drive circuit D1 and connect the battery 17*a* to the boat LAN system B.

When the power switch SW3 is turned on, it is possible to connect the battery 17*c* to the engine 20*c* of the outboard motor 12*c*, and at the same time, to connect the battery 17*a* to the boat LAN system B by turning on the switching circuit C2 with the drive circuit D2. In this way, by turning on any one of the power switches SW1, SW2, SW3, it is possible to connect the battery 17*a* to the boat LAN system B. Power supply to the boat LAN system B can thus be started by a power supply operation of any of the engines 20*a*, 20*b*, and 20*c* of the outboard motors 12*a*, 12*b*, and 12*c*, and thereby securing a single power supply.

Even if the power switch SW1 of the outboard motor 12*a* is turned off, the battery 17*a* remains connected to the boat LAN system B as long as the switching circuit C1 or the switching circuit C2 is on. Similarly, even if the power switch SW2 of the outboard motor 12*b* is off and the switching circuit C1 is off, the battery 17*a* remains connected to the boat LAN system B unless the power switch SW1 is off.

Further, even if the power switch SW3 of the outboard motor 12*c* is off and the switching circuit C2 is off, the battery 17*a* remains connected to the boat LAN system B unless the power switch SW1 is off.

As described above, even if any of the power switches SW1, SW2, and SW3 of the engines 20*a*, 20*b*, and 20*c* of the outboard motors 12*a*, 12*b*, and 12*c* is turned off, power supply to the boat LAN system B is not turned off as long as any one of the outboard motor power switches remains on. Until any one power switch of the plural outboard motors 12*a*, 12*b*, and 12*c* is turned off last, power to the boat LAN system B remains supplied. Thus, ease of use of the power supply system for the boat LAN system coping with plural engines is greatly improved.

With the illustrated embodiment, the power switches SW1, SW2, and SW3, switching circuits C1 and C2, and drive circuits D1 and D2 are combined on a switch panel 80 to form a power supply switch unit 81. The power supply switch unit 81 can be detachably connected to the system power supply circuit X. The power supply switch unit 81 can be formed, when the number of the outboard motors is three, by attaching the power switches SW1, SW2, and SW3, the switching circuits C1 and C2, and the drive circuits D1 and D2 to the switch panel 80. When only two outboard motors are used, the power switch unit 81 can be formed by attaching the power switches SW1 and SW2, the switching circuit C1, and the drive circuits D1 to the switch panel 80. Thus, the system power supply circuit X may be easily adapted to different numbers of the outboard motors, greatly improving ease of use.

Figure 2:
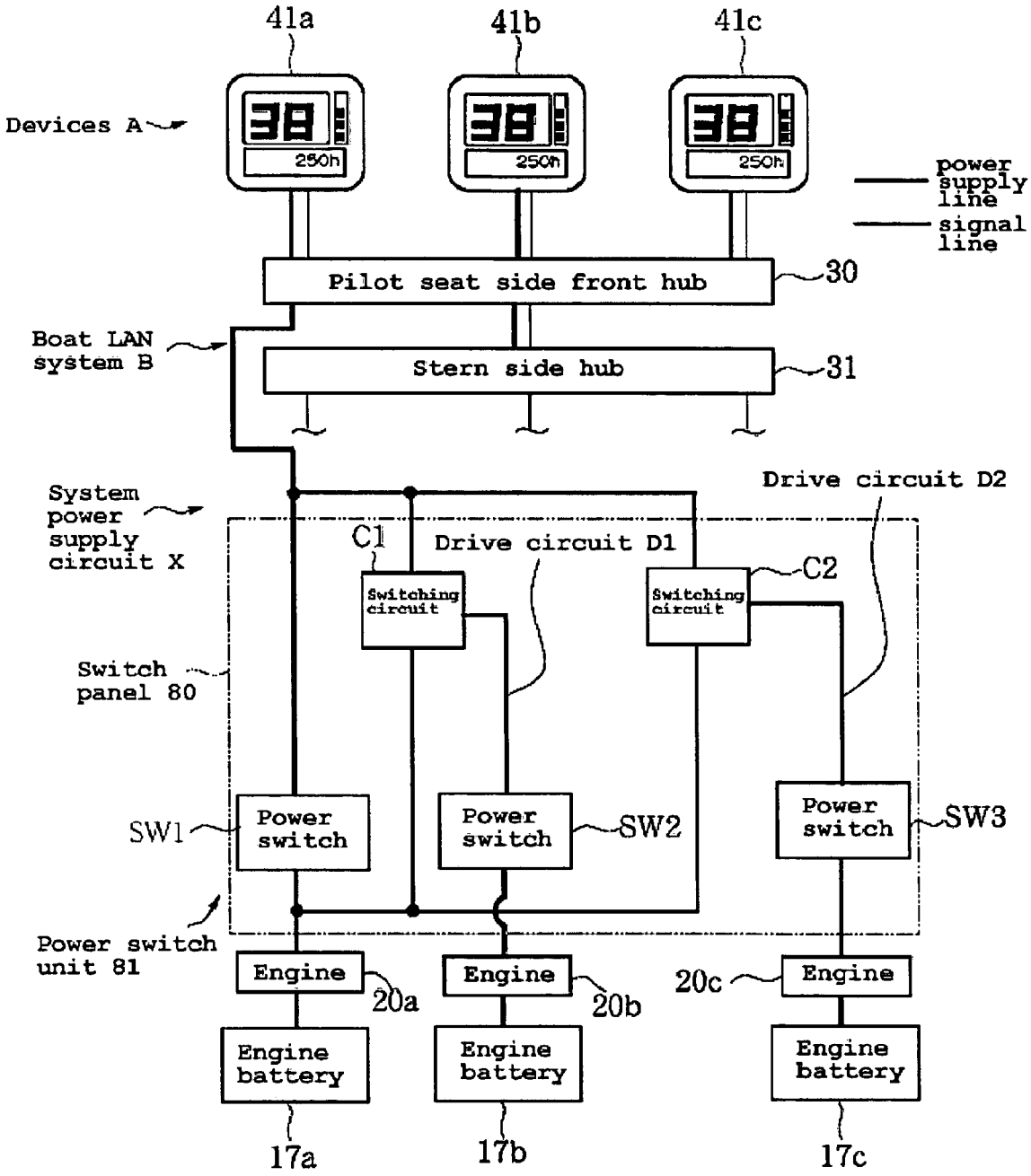
FIG. 2 is a block diagram of a power supply system that can be used with the LAN system of FIG. 1.
Figure 3:
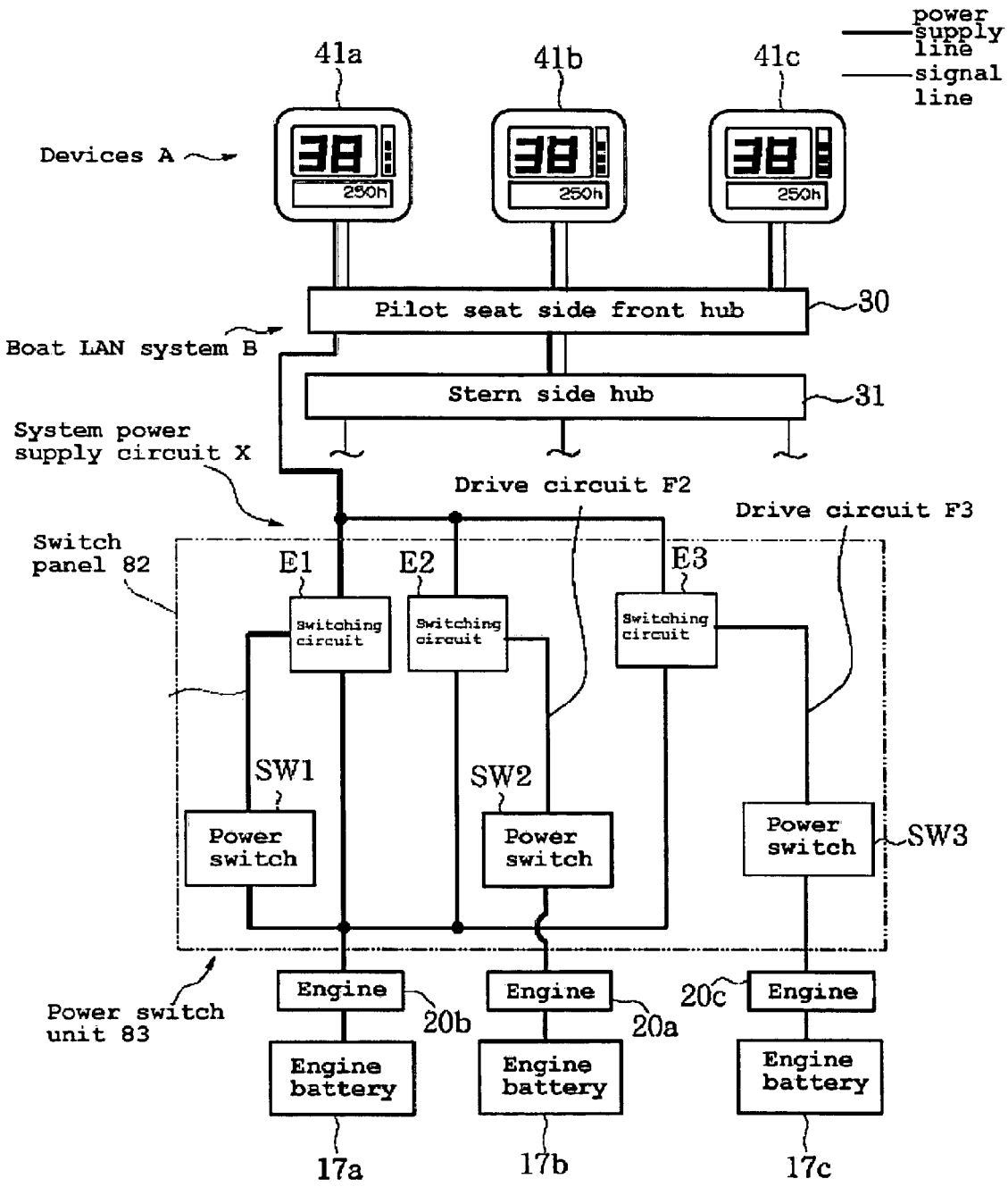
FIG. 3 is a block diagram of a modification of the power supply system illustrated in FIG. 2.

The embodiment of FIG. 3, like the embodiment of FIGS. 1 and 2, can comprise three outboard motors 12*a*, 12*b*, and 12*c*, their respective engines 20*a*, 20*b*, and 20*c*, and their respective batteries 17*a*, 17*b*, and 17*c* interconnected through power switches SW1, SW2, and SW3.

In some embodiments, the battery 17*a* of the selected outboard motor 12*a* can connected to the boat LAN system B. For example, switching circuits E1, E2, and E3 corresponding to the power switches SW1, SW2, and SW3 of the engines 20*a*, 20*b*, and 20*c* are connected in parallel with the battery 17*a* corresponding to the engine 20*a* of the single outboard motor 20*a*.

Further, drive circuits F1, F2, and F3 for turning on and off the switching circuits E1, E2, and E3 corresponding to the power switches SW1, SW2, and SW3 can also be provided. The switching circuits E1, E2, and E3 can be, for example, but without limitation, relay circuits. Where normally open contact point type relay circuits are used, such can be either a mechanical contact point type or a non-contact type of semiconductor relay circuit.

When the power switch SW1 (FIG. 3) is turned on, it is possible to connect the battery 17*a* to both the engine 20*a* of the outboard motor 12*a* and the boat LAN system B. In this example, the drive circuit F1 turns on the switching circuit E1. Further, when the power switch SW2 is turned on, it is possible to connect the battery 17*b* to the engine 20*b* of the outboard motor 12*b*. At the same time, it is possible to turn on the switching circuit E2 with the drive circuit F2 and connect the battery 17*a* to the boat LAN system B. When the power switch SW3 is turned on, it is possible to connect the battery 17*c* to the engine 20*c* of the outboard motor 12*c*, and at the same time, to connect the battery 17*a* to the boat LAN system B, as the drive circuit F3 turns on the switching circuit E3.

In this way, by turning on the power switch SW1 or any one of other power switches SW2, SW3, it is possible to connect the battery 17*a* to the boat LAN system B. Power supply to the boat LAN system B can be started by a power supply operation on any of the engines 20*a*, 20*b*, and 20*c* of the outboard motors 12*a*, 12*b*, and 12*c* while securing a single power supply.

Even if the power switch SW1 of the outboard motor 12*a* is turned off, the battery 17*a* remains connected to the boat LAN system B as long as the switching circuit E2 or the switching circuit E3 is on. Similarly, even if the power switch SW2 is turned off, the battery 17*a* is connected to the boat LAN system B, as long as the switching circuits E1 or the switching circuits E3 is on. Finally, even if the power switch SW3 of the outboard motor 12*c* is turned off, the battery 17*a* is connected to the boat LAN system B, as long as the switching circuits E1 or the switching circuits E2 is on.

As described above, if any one of the power switches SW1, SW2, and SW3 of the engines 20*a*, 20*b*, and 20*c* of the outboard motors 12*a*, 12*b*, and 12*c* is turned off, power supply to the boat LAN system is not turned off as long as the power switch of any one of the outboard motors remains on. Until any one of power switches of the plural outboard motors 12*a*, 12*b*, and 12*c* is turned off last, power to the boat LAN system B remains supplied. Thus, ease of use of the power supply system for the boat LAN system coping with plural engines is greatly improved.

With this embodiment, the power switches SW1, SW2, and SW3, switching circuits E1, E2, and E3, and drive circuits F1, F2, and F3 are combined on a switch panel 82 to form a power supply switch unit 83. The power supply switch unit 83 is detachably connected to the system power supply circuit X.

The power supply switch unit 83 can be formed, when the number of the outboard motors is three, by attaching the power switches SW1, SW2, and SW3, switching circuits E1, E2, and E3, and drive circuits F1, F2, and F3 to the switch panel 82. When only two outboard motors are used, the power supply switch unit 83 can be formed by attaching the power switches SW1 and SW2, the switching circuits E1 and E2, and the drive circuits F1 and F2 to the switch panel 82. Thus, the system power supply circuit X may be easily adapted to different numbers of the outboard motors, greatly improving ease of use.

Although these inventions have been disclosed in the context of certain preferred embodiments and examples, it will be understood by those skilled in the art that the present inventions extend beyond the specifically disclosed embodiments to other alternative embodiments and/or uses of the inventions and obvious modifications and equivalents thereof. In addition, while several variations of the inventions have been shown and described in detail, other modifications, which are within the scope of these inventions, will be readily apparent to those of skill in the art based upon this disclosure. It is also contemplated that various combination or sub-combinations of the specific features and aspects of the embodiments may be made and still fall within the scope of the inventions. It should be understood that various features and aspects of the disclosed embodiments can be combined with or substituted for one another in order to form varying modes of the disclosed inventions. Thus, it is intended that the scope of at least some of the present inventions herein disclosed should not be limited by the particular disclosed embodiments described above.

What is claimed is:

1. A power supply system for a networking system of a boat having a plurality of engines, a plurality of devices disposed in an operator's area of a hull of a boat, a plurality of propulsion units, including at least a first propulsion unit, supported by the hull, a plurality of engines having engine controllers and being configured to power the respective propulsion units, a networking system comprising a communication network between the devices and the engine controllers, a plurality of batteries, including at least a first battery, corresponding to the plurality of engines and connected to the respective engines through a plurality of respective power switches, including at least a first power switch, the first power switch connecting the first battery to the first propulsion unit, the power supply system comprising a system power supply circuit configured to connect the first battery to the networking system, a plurality of switching circuits configured to connect the first battery to the networking system while bypassing the first power switch, and drive circuits configured to turning on and off the switching circuits as interlocked with power switches other than the first power switch.

2. The power supply system according to claim 1, wherein the power switches, switching circuits, and drive circuits are combined on a switch panel to form a power supply switch unit, and the power supply switch unit is configured to be changeable to accommodate varying numbers of the propulsion units.

3. A power supply system for a networking system of a boat having a plurality of engines, a plurality of devices disposed in an operator's area of the hull of a boat, a plurality of propulsion units, including at least a first propulsion unit, supported by the hull, a plurality of engines having engine controllers and being configured to power the respective propulsion units, a networking system comprising a communication network between the devices and the engine controllers, a plurality of batteries corresponding to the plurality of engines and connected to the respective engines through a plurality of respective power switches, a system power supply circuit configured to connect a first battery of the plurality of batteries to the boat networking system, a plurality of switching circuits corresponding to the power switches of the respective propulsion unit engines connected in parallel with the first battery, and drive circuits configured to turn on and turn off the corresponding switching circuits as interlocked with the respective power switches.

4. The power supply system according to claim 3, wherein the power switches, switching circuits, and drive circuits are combined on a switch panel to form a power supply switch unit, and the power supply switch unit is configured to be changeable to accommodate varying numbers of the propulsion units.

* * * * *